US005305927A

United States Patent [19]

Caveza

[11] Patent Number: 5,305,927

[45] Date of Patent: Apr. 26, 1994

[54] HAND-PUMPED TOY BEVERAGE DISPENSER

[75] Inventor: Martin J. Caveza, Redondo Beach, Calif.

[73] Assignee: Mattel, Inc., El Segundo, Calif.

[21] Appl. No.: 10,725

[22] Filed: Jan. 29, 1993

[51] Int. Cl.[5] ..... B67D 5/06

[52] U.S. Cl. ..... 222/185; 222/424; 366/137

[58] Field of Search ..... 222/129, 129.1, 135, 222/136, 185, 190, 196, 318, 424, 401; 446/475, 483; 366/136, 137, 159, 267, 268

[56] References Cited

U.S. PATENT DOCUMENTS

| | | | |
|---|---|---|---|
| 400,386 | 3/1889 | Armitstead | 222/318 |
| 2,529,407 | 11/1950 | Midouhas | 222/129 |
| 3,100,588 | 8/1963 | Pearson, Jr. | 222/156 |
| 3,193,149 | 7/1965 | Beaubien | 222/109 |
| 3,341,077 | 9/1967 | Gordon | 222/129.1 |
| 3,503,541 | 3/1970 | Jacobs et al. | 222/129.1 |
| 4,294,293 | 10/1981 | Lorenz et al. | 366/267 |
| 4,531,654 | 7/1985 | Guyon | 222/78 |
| 4,907,723 | 3/1990 | Katz | 222/196 |
| 4,967,939 | 11/1990 | Taylor | 222/196 |
| 5,100,025 | 3/1992 | McGraw | 222/156 |

*Primary Examiner*—Andres Kashnikow
*Assistant Examiner*—Philippe Derakshani
*Attorney, Agent, or Firm*—Roy A. Ekstrand

[57] ABSTRACT

A hand-pumped toy beverage dispenser includes a dual cavity beverage reservoir supported by a support member and having a pair of dispensing valve assemblies coupled to the respective beverage reservoirs. The beverage dispenser further includes a pair of manually operated liquid pumps which the child user actuates by rapid manipulation of a pair of depressible pump actuators to circulate the beverage liquid through the pump mechanism for mixing and visual effect.

4 Claims, 3 Drawing Sheets

HAND-PUMPED TOY BEVERAGE DISPENSER

FIELD OF THE INVENTION

This invention relates generally to beverage dispensers and particularly to those used as children's toys.

BACKGROUND OF THE INVENTION

Beverage dispensers for cold drinks are popular and extremely plentiful in major industrial nations such as the United States of America. Such beverage dispensers are found in restaurants, coffee shops, fast food facilities and virtually any facility which sells or dispenses food items. While a variety of different designs and constructions have been provided by practitioners in the art, all generally include a support frame upon which one or more beverage containers defining interior reservoirs are supported. Each reservoir typically defines a clear portion and supports an electric motor driven pump and circulating apparatus together with one or more beverage dispensing valves and nozzles. The objective of such beverage dispensers is to provide a continuous circulation and mixing action for the beverage within the reservoir. In addition, the circulation path typically includes a cooling element through which the beverage is circulated. The circulation of the beverage is often sprayed or directed against the interior walls of the reservoir clear portion to provide an attractive display function.

U.S. Pat. No. 3,341,077 issued to Gordon sets forth a MULTI-BEVERAGE DISPENSER having an upwardly extending support housing upon which a pair of clear beverage containers are supported. An intermediate wall defines the two beverage containers into separate reservoirs. A siphon and pump mechanism is supported within each of the beverage reservoirs and is operative to continuously circulate and cool the beverage therein. A pair of dispensing nozzles are supported at the lower portion of the beverage containers to facilitate dispensing of either of the beverages.

U.S. Pat. No. 3,503,541 issued to Jacobs, et al. sets forth a MULTIBEVERAGE DISPENSER in which a support frame receives and supports a plurality of dispensing nozzles and a common water chamber. A plurality of syrup supplies are coupled to the dispensing nozzles through lever actuated valves. Each dispensing nozzle is further coupled through an additional valve mechanism to the common water supply reservoir. When a given valve is operated to dispense a beverage, the syrup supply and water are concurrently introduced into a mixing chamber and dispensed from the nozzle into the beverage.

U.S. Pat. No. 4,531,654 issued to Guyon sets forth a DRINK DISPENSING DEVICE configured to simulate the appearance and operation of an oil drilling rig or the like. A base structure supports a model of a drilling rig and a plurality of drink dispensers. Each drink dispenser comprises a solenoid which when actuated releases a predetermined amount of liquid into a collection device leading to a receptacle. Control circuitry controls a selection switch for selecting a drink dispenser solenoid. The circuitry also causes the drilling rig to appear to operate in combination with the filling operation.

The natural interest of children in mimicking adult activities has not surprisingly lead to the creation of a variety of toy products which includes toy beverage dispensers and toy soda fountains. For example, U.S. Pat. No. 3,100,588 issued to Pearson, Jr. sets forth a TOY LIQUID DISPENSING DEVICE having an upwardly extending base member and support defining a beverage cup receiving surface. A beverage reservoir is supported above the cup receiving surface and defines an interior beverage cavity and a downwardly extending dispensing nozzle. A battery-operated electric circulating pump is operatively coupled to the beverage within the reservoir and provides a circulation thereof.

U.S. Pat. No. 3,193,149 issued to Beaubien sets forth a TOY LIQUID DISPENSER having a beverage receptacle within Which a quantity of beverage is received and mixed. The dispenser further includes an upwardly extending hand-operated lever pump having a discharge aperture therein. A siphon and valve assembly is operatively coupled to the pump lever and functions in a similar manner and action to the typical hand pumps used in early water wells within the United States and elsewhere. As the lever is operated, the valve mechanism lifts the beverage upwardly from the lower beverage container through a siphon tube and discharges it through the upper discharge aperture of the pump assembly.

U.S. Pat. No. 2,529,407 issued to Midouhas sets forth TOY SODA FOUNTAIN having a base member configured to resemble a miniature soda fountain counter. A plurality of syrup dispensing mechanisms are supported within the base member on either side of a water dispensing nozzle. The syrup dispensers and water dispenser each include a hand-operated pump mechanism which is operative to dispense the syrup and water to provide soda fountain mixing of beverages.

While the foregoing described prior art devices have provided beverage dispensers for both commercial and toy use, there remains nonetheless a continuing need in the toy art for evermore interesting and amusing types of beverage dispensing toys to maintain the interest of child users.

SUMMARY OF THE INVENTION

Accordingly, it is a general object of the present invention to provide an improved toy beverage dispenser. It is a more particular object of the present invention to provide an improved toy beverage dispenser which utilizes an amusing hand operated pumping mechanism to further improve the amusement value thereof.

In accordance with the present invention there is provided a toy beverage dispenser comprises: a support member having a support base and upwardly extending walls; a beverage reservoir supported by the walls and defining a pair of beverage cavities; a pair of dispensing valves each coupled to one of the beverage cavities for dispensing a beverage therefrom; a pair of pumps each coupled to one of the beverage cavities and each operative to draw beverage from one of the cavities upwardly and to discharge it outwardly above the one of the beverage cavities; and a pair of hand manipulated pump actuators each coupled to and operating one of the pair of pumps, the pump responding solely to the pump actuators.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
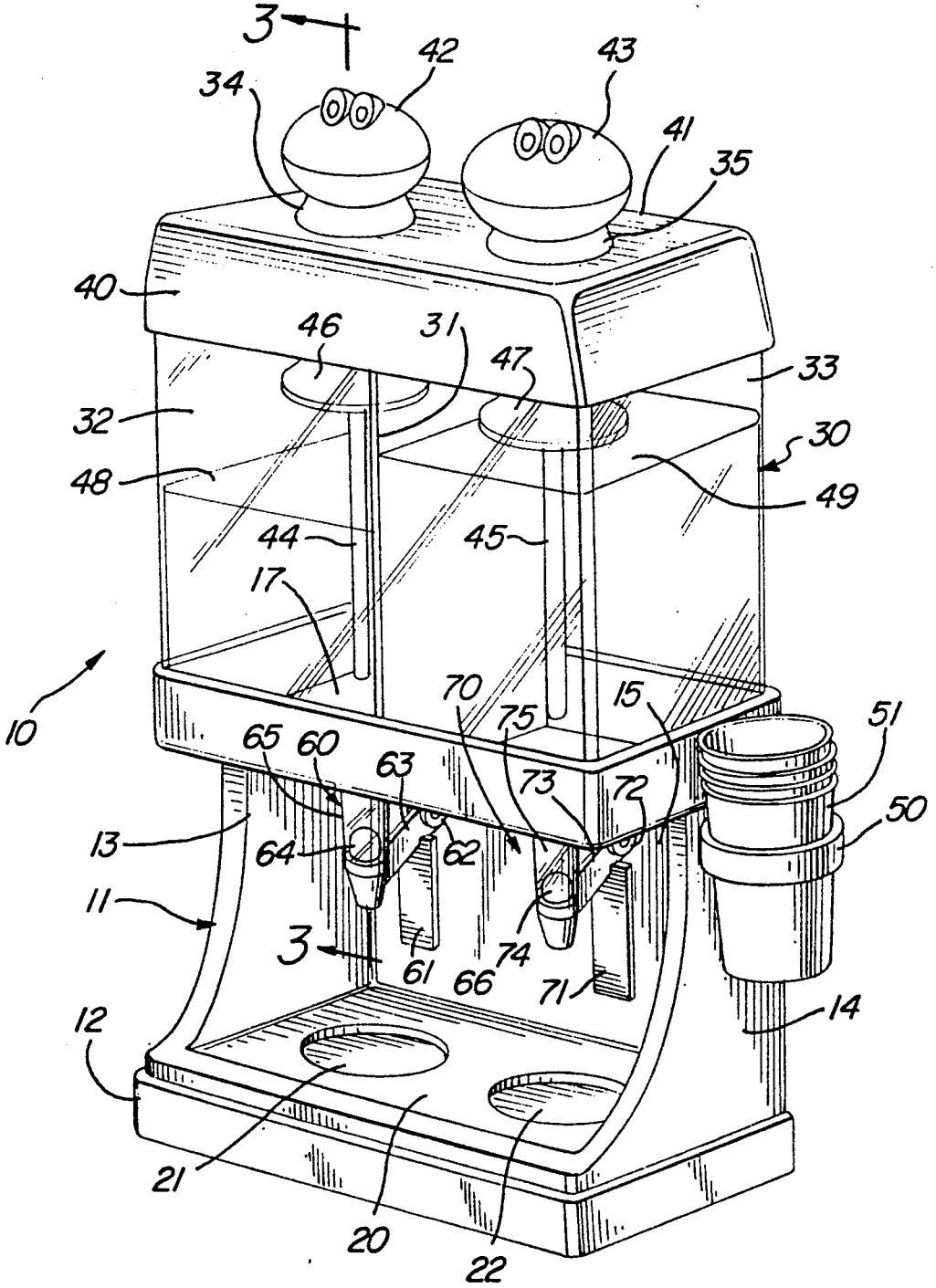
FIG. 1 sets forth a perspective view of a toy beverage dispenser constructed in accordance with the present invention.

FIG. 1 sets forth a front perspective view of a toy beverage dispenser constructed in accordance with the present invention and generally referenced by numeral 10. Beverage dispenser 10 includes a support portion 11 formed of a generally rectangular base 12 having a pair of upwardly extending side walls 13 and 14 and a rear wall 15. The upper portion of base 12 forms a generally planar cup surface 20 defining a pair of cylindrical cup recesses 21 and 22. A generally rectangular attachment ring 16 is secured to side walls 13 and 14 by a pair of downwardly extending tabs 23 and 24 which cooperate with a pair of slots 18 and 19 in side walls 13 and 14 and which are better seen in FIG. 2. A beverage reservoir 30 defines a bottom surface 17 having a pair of downwardly extending nozzles 65 and 75 and a dividing wall 31 formed therein. In its preferred form, reservoir 30 is fabricated of a clear or colored transparent material such as molded plastic or the like.

Dividing wall 31 separates reservoir 30 into a pair of distinct beverage cavities 32 and 33 each communicating with nozzles 65 and 75 respectively in the manner set forth below in FIG. 3.

Toy beverage dispenser 10 further includes a generally rectangular upper cover 40 received upon the upper portion of beverage reservoir 30 and defining a pair of upwardly extending neck portions 34 and 35. By means set forth below in greater detail, a pair of depressible pump actuators 42 and 43 are movably supported upon necks 34 and 35 respectively and are coupled to a pair of beverage dispersers 46 and 47 and siphon tubes 44 and 45 within beverage cavities 32 and 33 respectively. A cylindrical cup ring 50 is secured to side wall 14 by means set forth below in greater detail and receives and stores a plurality of beverage cups 51. A pair of dispensing valve assemblies 60 and 70 are supported upon the underside of attachment ring 16. The structures of dispensing valve assemblies 60 and 70 are set forth below in greater detail in FIG. 3. Suffice it to note here, however, that dispensing valve assembly 60 includes a lever 61 and a generally perpendicular arm 63 coupled to a pivot 62 upon the underside of attachment ring 16. Arm 63 supports a stopper 64 which sealingly engages nozzle 65 to provide closure of nozzle 65 and beverage cavity 32. Similarly, dispensing valve 70 includes a downwardly extending lever 71 and arm 73 in perpendicular arrangement which is pivotally coupled to attachment ring 16 at pivot 72. Arm 73 supports a stopper 74 which sealingly engages nozzle 75 to provide closure thereof.

In operation and by means set forth below in greater detail, a supply of liquid beverage 48 is received within beverage cavity 32 while a supply of another beverage 49 is received within beverage cavity 33. As described above, beverage cavities 32 and 33 are separate and distinct and thus the respective beverages therein remain correspondingly separated. As is also described below in greater detail, nozzles 65 and 75 communicate with beverage cavities 32 and 33 respectively and provide dispensing nozzles for beverages 48 and 49. This dispensing activity is carried forward by selecting a cup from cup supply 51 and placing it from within a cup recess such as cup recess 21. Once a cup is placed within cup recess 21, lever 61 is pivoted rearwardly in the direction indicated by arrow 66 thereby causing arm 63 to pivot downwardly withdrawing stopper 64 from nozzle 65. Once stopper 64 is withdrawn from its sealing engagement with nozzle 65, beverage 48 within beverage cavity 32 flows downwardly through the communicating passage (seen in FIG. 3) within nozzle 65 and into the receiving cup within recess 21. When the desired quantity of beverage has been dispensed, lever 61 is released and returns to the position shown in FIG. 1 causing stopper 64 to be reengaged with nozzle 65 and terminating the flow of beverage from beverage cavity 32.

Dispensing valve assembly 70 functions in an identical manner to dispense beverage 49 from beverage cavity 33 downwardly through nozzle 75 into a cup received and supported within cup recess 22.

In accordance with an important aspect of the present invention, a pair of manually operated siphon and pump mechanisms are supported within beverage cavities 32 and 33 and are operatively coupled to pump actuators 42 and 43. The structure and operation of these siphon and pump mechanisms are set forth below in FIG. 3 in greater detail. However, suffice it to note here that in accordance with an important and entertaining play pattern of the present invention toy beverage dispenser, the child user may actuate either pump mechanism by depressing the respective pump actuator in a preferably rapid depress and release manipulation. For example, in the event the child user rapidly depresses and releases pump actuator 42 in a series of hand pumping actions, beverage 48 within beverage cavity 32 is drawn upwardly through siphon tube 44 into the pump mechanism and dispersed downwardly and outwardly across the upper surface of disperser 46. This action provides considerable entertainment value for the child user and also performs the desirable mixing function for beverage 48.

Similarly, the child user may actuate the pump mechanism within beverage cavity 33 by rapidly depressing and releasing pump actuator 43 to provide circulation of beverage 49 within beverage cavity 33 upwardly through siphon tube 45 and outwardly across the upper surface of disperser 47. If desired, the child user may operate actuators 42 and 43 concurrently or switch back and forth therebetween to provide the desired mixing and pumping action.

Thus, the child user is able through hand manipulation of pump actuators 42 and 43 to control the circulation of beverages 48 and 49 within beverage cavities 32 and 33 of reservoir 30. This operation provides stimulation of the child user's manual dexterity and displays a beverage circulation similar to that used in conventional electric pump driven beverage dispensers. At any desired time during the play pattern, the child user may terminate the pumping and circulating action to dispense either or both of the beverages using dispensing valve assemblies 60 or 70 as described above. In addition to providing an entertaining activity for the child user, the hand-operated pump mechanisms within toy beverage dispenser 10 may also be used to perform beverage mixing functions for further interest and entertainment value. For example, beverage cavities 32 and 33 may be filled with clear water and a dry powder beverage ingredient may be added directly to the water. Once the beverage powder has been added, the operation of the pumping mechanism is used to circulate and mix the beverage powder and water to constitute the beverage. Once mixing is complete, a quantity of beverage may be dispensed using the appropriate dispensing valve assembly.

Figure 2:
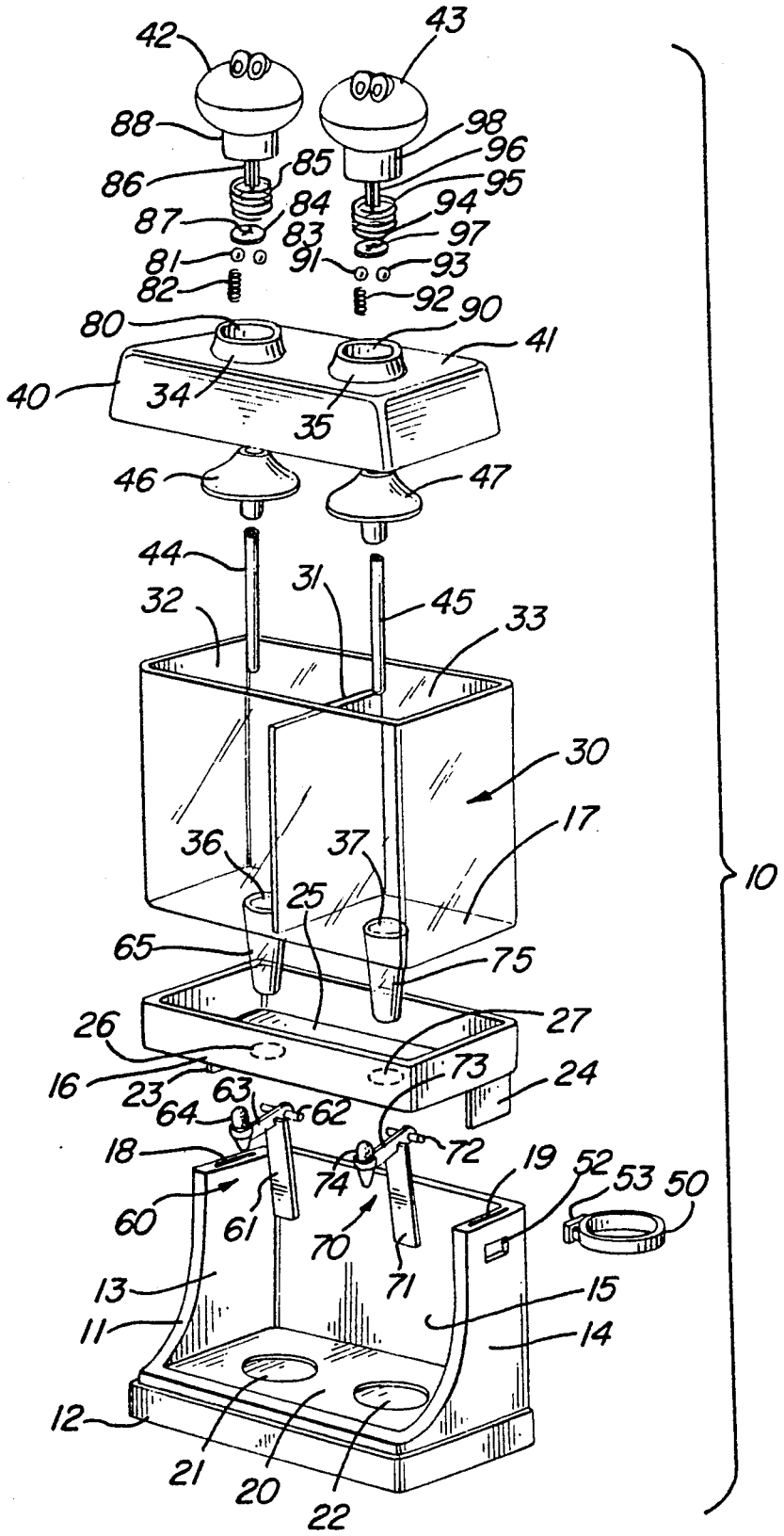
FIG. 2 sets forth a perspective assembly view of toy beverage dispenser constructed in accordance with the present invention.

FIG. 2 sets forth a perspective assembly view of toy beverage dispenser 10. As described above, beverage dispenser 10 includes a support 11 having a generally rectangular base portion 12 and a pair of upwardly extending side walls 13 and 14 together with an upwardly extending rear wall 15. Support 11 further defines a generally planar cup surface defining a pair of cup recesses 21 and 22. In its preferred form support 11 is fabricated of a single molded plastic member. Side walls 13 and 14 define a pair of upwardly opening elongated slots 18 and 19. Side wall 14 further defines a generally rectangular aperture 52. A cup ring 50 forms a generally cylindrical member having a rectangular tab 53 extending therefrom. Tab 53 is received within aperture 52 to secure cup ring 50 to side wall 14.

A generally rectangular attachment ring 16 defines a planar support surface 25 defining a pair of apertures 26 and 27 defined therein. Attachment ring 16 further defines a pair of downwardly extending elongated tabs 23 and 24. Tabs 23 and 24 are received within slots 18 and 19 respectively to secure attachment ring 16 to side walls 13 and 14.

A beverage reservoir 30 defines a generally rectangular 10 reservoir having a bottom surface 17 and a pair of downwardly extending frustro-conical nozzles 65 and 75. Bottom surface 17 further defines a pair of nozzle passages 36 and 37 extending through bottom surface 17 and nozzles 65 and 75 respectively. Dividing wall 31 separates beverage reservoir 30 into a pair of beverage cavities 32 and 33. Beverage reservoir 30 is assembled to attachment ring 16 such that the lower end of reservoir 30 is received within attachment ring 16 and nozzles 65 and 75 extend downwardly through apertures 26 and 27 respectively.

Figures 3, 4:
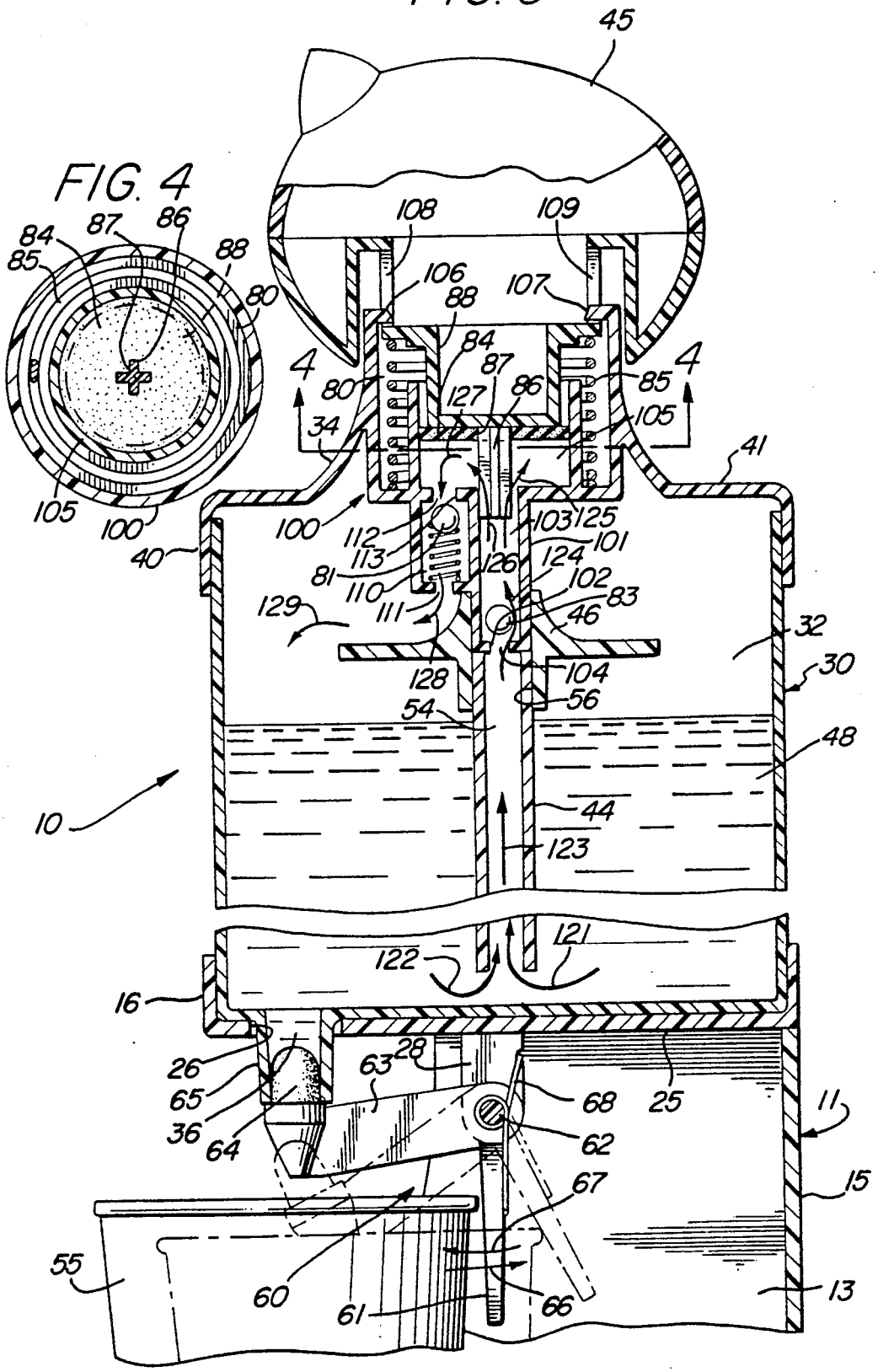
FIG. 3 sets forth a section view of the present invention toy beverage dispenser taken along section lines 3—3 in FIG. 2.
FIG. 4 sets forth a section view of the present invention toy beverage dispenser taken along section lines 4—4 in FIG. 3.

By means better seen in FIG. 3, dispensing valve assembly 60 is pivotally secured to the underside of attachment ring 16 by pivot 62. Dispensing valve assembly 60 includes a downwardly extending lever 61 and a perpendicularly extending arm 63. Arm 63 supports a resilient stopper 64 which, as is also better seen in FIG. 3, is receivable within the lower portion of nozzle 65 when valve assembly 60 is in the closed position shown in FIGS. 1 and 3. In a similar attachment, dispensing valve assembly 70 is pivotally secured to attachment ring 16 and includes a pivot 72, a lever 71, an arm 73 and a resilient stopper 74. By way of further similarity, stopper 74 is receivable within the lower portion of nozzle 75 to provide closure thereof when dispensing valve assembly 70 is in the closed position shown in FIG. 1.

Toy beverage dispenser 10 further includes a generally rectangular upper cover 40 having an upper surface 41 and a pair of upwardly extending neck portions 34 and 35. In the manner set forth below in greater detail in FIGS. 3 and 4, upper cover 40 defines a pump chamber extending downwardly through neck 34. A second pump chamber 90 identical to pump chamber 80 extends downwardly through neck 35. A pair of generally conical dispersers 46 and 47 are received within upper cover 40 and support a pair of elongated hollow downwardly extending siphon tubes 44 and 45. Pump actuator 42 defines a downwardly extending generally cylindrical piston 88 having a seal guide 86 extending downwardly therefrom. A coil spring 85 encircles piston 88. A resilient disk-shaped seal 84 defines a cruciform-shaped aperture 87 which is received upon seal guide 86 to secure seal 84 to the undersurface of piston 88. A ball 81 and a spring 82 are supported within a check valve assembly (shown in FIG. 3) and a ball 83 is received within a check valve within disperser 46 (also seen in FIG. 3). By means set forth below in greater detail, balls 81 and 83 together with spring 82 cooperate to provide single direction flow and siphoning action when pump actuator 42 is manipulated in the manner described above.

Pump actuator 43 defines a cylindrical piston 88 and a seal guide 96 identical to piston 88 and seal guide 86 of pump actuator 42. By way of further similarity, a coil spring 95 and a resilient seal 94 having a cruciform-shaped aperture 97 defined therein are identical to spring 85 and resilient seal 84. A pair of ball members 91 and 93 together with a spring 92 are operatively received within upper cover 40 in an identical fabrication to that described below in FIG. 3 for balls 81 and 83 and spring 82. Thus, while FIG. 3 sets forth the operative structure responding to pump actuator 42 in great detail, it should be understood that the operative structure responding to pump actuator 43 while not shown or described beyond that seen in FIG. 2 is identical to that shown in FIG. 3 for pump actuator 42.

Thus, the assembly of toy beverage dispenser 10 is completed by assembling dispersers 46 and 47 to upper cover 40 and siphon tubes 44 and 45 to dispersers 46 and 47 respectively. Similarly, springs 82 and 92, balls 81 and 91, balls 83 and 93, seals 84 and 94 and springs 85 and 95 are assembled within upper cover 40 together with pump actuators 42 and 43 to complete the assembly of toy beverage dispenser 10.

FIG. 3 sets forth a section view of toy beverage dispenser 10 taken along section lines 3—3 in FIG. 1. Toy dispenser 10 includes a support 11 having a side wall 13 and a rear wall 15. An attachment ring 16 is secured to support 11 in the manner described above and defines a support surface 25 and a pair of apertures 26 and 27 (the latter seen in FIG. 2). A plurality of flanges such as flange 28 extend downwardly from attachment ring 16 and provide pivotal attachment for dispensing valve assembly 60. As described above, dispensing valve 60 includes a lever 61 and a perpendicularly joined arm 63 coupled to a pivot 62. Pivot 62 is pivotally secured to flange 28 in a conventional attachment. Valve assembly 60 further includes a resilient stopper 64 supported at the end of arm 63. A beverage reservoir 30 defines a beverage cavity 32 and a downwardly extending nozzle 65. Nozzle 65 extends through aperture 26 of attachment ring 16 and defines a nozzle passage 36 in communication with beverage cavity 32. The length of arm 63 and the position of flange 28 are selected to provide alignment between resilient stopper 64 and the lower end of nozzle passage 36 when valve assembly 60 is configured in the closed position shown in solid line representation in FIG. 3. A coil spring 68 is received upon pivot 62 and exerts a spring force between flange 28 and lever 61 urging lever 61 in the rotational direction indicated by arrow 67. The rotational force of spring 68 upon lever 61 is coupled to stopper 64 by arm 63 forcing resilient stopper 64 into a sealing engagement with nozzle passage 36. Thus, with dispensing valve assembly 60 in the position shown in solid line representation in FIG. 3, stopper 64 provides a sealing closure of nozzle passage 36. A quantity of to-be-dispensed beverage 48 is received within beverage cavity 32 and may be dispensed therefrom by opening dispensing valve assembly 60. Valve assembly 60 is opened by pivoting lever 61 in the direction indicated by arrow 66 to the dashed line position shown. The pivotal motion of lever 61 causes a corresponding pivotal motion of arm 63 withdrawing stopper 64 from nozzle passage 36 of nozzle 65. With stopper 64 withdrawn from nozzle passage 36, beverage 48 is able to flow outwardly through nozzle 65 and into a cup 55 supported beneath nozzle 65. Once the desired quantity of beverage has been dispensed, lever 61 is released and the force of spring 68 acts upon lever 61 in the direction of arrow 67 pivoting arm 63 upwardly and reinserting stopper 64 into nozzle passage 36.

Toy beverage dispenser 10 further includes an upper cover 40 defining an upper surface 41 and a pair of upwardly extending neck portions 34 and 35 (the latter seen in FIG. 1). Upper cover 40 further defines a pump body 100 extending downwardly from neck 34 and forming a pump chamber 80 within the interior of neck 34. Pump body 100 further defines a plurality of inwardly extending tabs such as tabs 106 and 107. Pump body 100 also defines a generally cylindrical pump cylinder 105 generally concentric with pump chamber 80. Pump cylinder 105 forms a closed end cylinder defining an aperture 113 and a downwardly extending passage 103. Passage 103 extends through a downwardly extending input tube 101 which terminates in a valve seat 102 and an aperture 104. A check ball 83 is received within passage 103. Ball 83 is preferably formed of a heavy material such as metal and is greater in diameter than valve seat 102. Pump body 100 further defines an output chamber 110 having an output aperture 111 formed at the lower end thereof. Output chamber 110 further defines a valve seat 112 encircling aperture 113. A check ball 81 and a spring 82 are supported within chamber 110 such that spring 82 urges check ball 81 upwardly against seat 112 closing aperture 113.

Pump actuator 42 includes a downwardly extending piston 88 which is received within pump chamber 80 and extends into pump cylinder 105. Piston 88 further supports a downwardly extending cruciform cross-sectional shaped guide member 86 which extends into passage 103 of input tube 101. A resilient seal 84 defines a cruciform-shaped aperture 87 and is received upon guide 86 and supported thereby in contact with the lower surface of piston 88. Seal 84 is configured to resiliently seal piston 88 against the interior wall of pump cylinder 105. Pump actuator 42 further defines a plurality Of elongated slots such as slots 108 and 109 which receive tabs 106 and 107 respectively to captivate piston 88 within pump chamber 80 and pump cylinder 105. A coil spring 85 is compressively captivated between the lower surface of pump chamber 80 and pump actuator 42. Coil spring 85 encircles pump cylinder 105 and produces an expanding spring force between the lower surface of pump chamber 80 and actuator 42 forcing actuator 42 and piston 88 upwardly to the position shown in FIG. 3.

A disperser 46 defines a center passage 56 which receives the end portion of input tube 101 in a sealing attachment such as adhesive bonding or the like. Passage 56 also receives and supports the upper end of a hollow siphon tube 44 having a center passage 54 defined therein. Siphon tube 44 is also secured within passage 56 using a conventional attachment means such as adhesive bonding or the like.

In operation, beverage 48 may be pumped upwardly through siphon tube 44 and outwardly through aperture 111 of output chamber 110 as the child user rapidly and repeatedly presses pump actuator 32 downwardly and releases it to provide a series of pumping strokes. As pump actuator 42 is forced downwardly overcoming the expansive force of spring 85, piston 88 is driven downwardly through pump cylinder 105. Seal 84 provides a resilient seal between piston 88 and the interior wall of pump cylinder 105. As a result, the downward stroke of piston 88 produces a positive pressure within pump cylinder 105 which is communicated to passage 103 due to the cruciform shape of guide 86. The positive pressure exerted within pump cylinder 105 by piston 88 forces ball 83 downwardly against valve seat 102 closing input tube 101 and prohibiting the flow of liquid downwardly through siphon tube 44. Concurrently, the positive pressure within pump cylinder 105 exerts a downward force upon check ball 81 overcoming the spring force of spring 82 and permitting the flow of liquid through aperture 113, output chamber 110 and aperture 111 in the manner indicated by arrows 127 and 128. As the pumped liquid is forced outwardly through aperture 111, disperser 46 forces the liquid flow outwardly in the direction indicated by arrow 129 producing an amusing liquid flow effect and returning the liquid to beverage supply 48.

As pump actuator 42 is released, the force of spring 85 raises pump actuator 42 and piston 88 producing a negative pressure within pump cylinder 105. This negative pressure is communicated to passage 103 due to the cruciform shape of guide 86 and imparts a lifting force to ball 83. As ball 83 is lifted, it is removed from valve seat 102 and aperture 104 is opened to permit a responding upward flow of beverage 48 through passage 54 of siphon tube 44. This upward flow in the direction indicated by arrows 121 through 123 continues as piston 88 rises permitting the flow of liquid through aperture 104 past ball 83 as indicated by arrow 124. This flow ultimately is drawn upwardly into pump chamber 105 in the manner indicated by arrows 125 and 126. Concurrently the negative pressure or lack of positive pressure within pump cylinder 105 permits spring 82 to maintain an upward force upon check ball 81 forcing it into contact with seat 112 and closing aperture 113. The closure of aperture 113 by check ball 81 and spring 82 prevents air and liquid within output chamber 110 from being drawn into pump cylinder 105.

Thus, with each downward stroke of pump actuator 42, check ball 83 closes aperture 104 and check ball 81 is forced away from seat 112 opening aperture 113 and permitting liquid within pump cylinder 105 and output chamber 110 to be forced outwardly through aperture 111 past disperser 46. Conversely, with each return stroke or spring driven upward motion of pump actuator 42, piston 88 rises producing a negative pressure which draws ball 83 upwardly opening aperture 104 and permitting the replenishment of liquid within pump cylinder 105. During this upward stroke, check ball 81 maintains a seal against seat 112. As the downward and upward strokes are repeated in a rapid fashion, beverage 48 is circulated upwardly through siphon tube 44, input tube 101 and pump cylinder 105 and forced outwardly through aperture 111 of output chamber 110.

It has been found that the rapid pumping action provided by the apparatus shown produces substantial entertainment and amusement in young children and simultaneously provides effective mixing of the beverage liquid within the beverage cavity. As mentioned above, FIG. 3 sets forth the detailed structure of the siphon and pump mechanism responding to manipulation of pump actuator 42. As is also mentioned above, an identical siphon and pump mechanism is supported within upper cover 40 and is coupled to pump actuator 43 to produce the same siphoning and pumping action described in FIG. 3 when pump actuator 43 is manipulated. Thus, the manipulation of pump actuator 43 should be understood to provide a corresponding siphoning and pumping action of the beverage within beverage cavity 33 (seen in FIG. 2) in the same manner.

FIG. 4 sets forth a section view of toy beverage dispenser 10 taken along section lines 4—4 in FIG. 3. Once again, it should be understood that the descriptions set forth in FIG. 4 for the pump mechanism responsive to pump actuator 42 apply equally well to the pump mechanism responsive to pump actuator 43. Pump housing 100 defines a generally cylindrical member having a pump chamber 80 formed therein. A coil spring 85 is generally circular and is received within pump chamber 80. A pump cylinder 105 is smaller in diameter than pump housing 100 and is generally concentric therewith. A circular resilient seal 84 is received within pump cylinder 105 and defines a cruciform-shaped aperture 87. A cylindrical piston 88 includes a cruciform-shaped guide 86 extending through aperture 87 of resilient seal 84. Thus, as can be seen in FIG. 4, pump housing 100, coil spring 85, pump cylinder 105, seal 84 and piston 88 are all generally concentric and circular in cross-section.

What has been shown is a hand-pumped toy beverage dispenser having a pair of manually actuatable siphon and pump mechanisms supported within a dual cavity beverage dispenser. A corresponding pair of dispensing valve assemblies are operative to dispense beverage from each of the beverage cavities. The manually actuatable hand-pumping mechanisms permit the child user to exercise a series of rapid pumping strokes upon the actuators to circulate and mix the beverage within the beverage dispenser in a entertaining circulating visual effect. The circulation also provides effective mixing of the beverage within the beverage cavity. The dispenser operates without the use of any electrical power or battery power of any sort and operates to impart a dexterity improving activity for the child user.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy beverage dispenser containing:

a support member having a support base and upwardly extending walls;

a beverage reservoir supported by said walls and defining a pair of beverage cavities;

a pair of dispensing valves each coupled to one of said beverage cavities for dispensing a beverage therefrom;

a pair of pumps each coupled to one of said beverage cavities and each operative to draw beverage from one of said cavities upwardly and to discharge it outwardly above said one of said beverage cavities, said pumps each including a siphon tube extending into one of said beverage cavities, a discharge aperture above said one of said beverage cavities, and a disperser supported beneath said discharge aperture for deflecting beverage flowing from said discharge aperture outwardly; and a pair of hand manipulated pump actuators each coupled to and operating one of said pair of pumps and each including a depressible member and a return spring, said pump responding solely to said pump actuators.

2. A toy beverage dispenser as set forth in claim 1 further including an upper surface above said beverage reservoir and wherein said depressible members are supported above said upper surface.

3. A toy beverage dispenser comprising:

a housing defining a beverage cavity;

a dispensing valve coupled to said beverage cavity for dispensing beverage therefrom;

a hand-operated circulating beverage pump having a hand-operated pump actuator, a movable piston, a pump cylinder, an input siphon, and a discharge aperture; and a disperser proximate said discharge aperture, said movable piston being moved within said pump cylinder in response to movement of said pump actuator to draw beverage from said beverage cavity through said input siphon and force it out through said discharge aperture against said disperser.

4. A toy beverage dispenser as set forth in claim 3 wherein said hand-operated pump actuator includes a depressible member coupled to said piston and a return spring biasing said depressible member toward a position in which said piston is at least partially withdrawn from said pump cylinder.

* * * * *